US006112766A

United States Patent [19]

Zoeller et al.

[11] Patent Number: 6,112,766

[45] Date of Patent: Sep. 5, 2000

[54] LOW FLOW WASTEWATER AND EFFLUENT DISTRIBUTION SYSTEM

[75] Inventors: Kenneth E. Zoeller; William West; Matthew Byers, all of Louisville, Ky.

[73] Assignee: Zoeller Co., Louisville, Ky.

[21] Appl. No.: 09/160,055

[22] Filed: Sep. 24, 1998

[51] Int. Cl.[7] ..... F16K 11/02

[52] U.S. Cl. ..... 137/561 A; 405/36; 405/51

[58] Field of Search ..... 405/36, 51; 137/561 A

[56] References Cited

U.S. PATENT DOCUMENTS

| | | | |
|---|---|---|---|
| 3,497,067 | 2/1970 | Tyson . | |
| 3,956,137 | 5/1976 | Dempsey . | |
| 4,017,240 | 4/1977 | Nelson | 137/561 A |
| 4,298,470 | 11/1981 | Stallings . | |
| 4,605,501 | 8/1986 | Tyson . | |
| 4,838,731 | 6/1989 | Gavin . | |
| 4,907,619 | 3/1990 | Paulson | 137/561 A |
| 5,098,568 | 3/1992 | Tyson . | |
| 5,107,892 | 4/1992 | Plachy . | |
| 5,154,353 | 10/1992 | Plachy . | |
| 5,322,387 | 6/1994 | Heine et al. . | |
| 5,680,989 | 10/1997 | Palchy et al. . | |

*Primary Examiner*—A. Michael Chambers
*Attorney, Agent, or Firm*—Scott R. Cox

[57] ABSTRACT

A liquid distribution system for distributing effluent from a source of waste water. This liquid distribution system is contained within a distribution box and includes liquid inlet piping, a ramp system, and a low capacity liquid flow splitting system, including slots and capillary grooves. A high capacity flow splitting system may also be included. In addition, an adjustment system is incorporated into the liquid distribution system for maintaining the level of the liquid distribution system in the ground.

31 Claims, 9 Drawing Sheets

LOW FLOW WASTEWATER AND EFFLUENT DISTRIBUTION SYSTEM

TECHNICAL FIELD

This invention relates to an improved distribution system for wastewater and effluent. In particular, this invention relates to a liquid distribution system for dividing a low flow of wastewater or effluent into reasonably equal quantities for distribution to separate discharge pipes in an absorption field.

BACKGROUND ART

Wastewater and sewage disposal systems are designed to disperse wastewater and/or effluent discharged from a wastewater storage system or septic tank into an absorption field. For example, the effluent discharged from a septic tank is conventionally directed first into a standard effluent distribution box. The distribution box is intended to divide the flow of effluent into separate, reasonably equal quantities of effluent which then pass through separate discharge pipes for distribution in the absorption field. This division of effluent prevents overloading in a single discharge pipe. Unequal discharge of effluent in a single discharge pipe can result in disproportionate effluent loading in one of the discharge pipes which can saturate the soil in one location while other locations receive only minimal effluent.

Conventionally, distribution boxes contain a single sump, but may have a number of discharge pipes, each of which directs an allocated portion of the effluent into different locations in the absorption field. Each of the discharge pipes in the distribution box must be set at exactly the same depth to achieve distribution of equal quantities of effluent into each of the discharge pipes as water seeks its own level. If the discharge pipes are set at different depths, effluent entering the distribution box tends to flow out of the discharge pipe which is located at the lowest level in the distribution box even if the difference in elevation among the discharge pipes is minimal. Even recognizing the need to maintain the discharge pipes located within the distribution box at the same depth, it is often difficult to install the discharge pipes perfectly level within the ground. In addition, even if the discharge pipes are properly installed, it is difficult to maintain them in a perfectly level position because of settling of the ground and other naturally occurring events.

A number of discharge systems have been proposed to solve this problem of equalizing the flow of effluent out of a distribution box. For example, U.S. Pat. No. 4,298,470 discloses a sewage septic system which includes a septic tank (14) and a distribution box (20), wherein the piping (26) for the effluent in the distribution box (20) includes a liquid leveling cap (34) containing an effluent opening (40). The level of these openings (40) in the caps (34) can be adjusted to accommodate different effluent levels of the piping within the distribution box (20).

U.S. Pat. No. 3,497,067 discloses a distribution box (10) used in conjunction with a septic tank absorption field system to control the relative flow of septic tank effluent among separate discharge pipes (18). In this system, a flow divider, or partition (19), is provided in a lower portion of the distribution box (10). This flow divider (19) has an upwardly projecting knife edge (20) designed to divide the flow of effluent entering the distribution box (10) into separate, generally equal quantities, regardless of the level of the discharge pipes (18) in the distribution box (10). An improvement on this system is disclosed in U.S. Pat. No. 4,605,501. In this system, the flow divider (26) is designed with a particular shape which fits within the discharge pipes (14).

An additional improvement on this system is disclosed in U.S. Pat. No. 5,098,568. In this system the distribution joint (18) contains two or more distribution lines **(16*a* and 16*b*) leading to separate adsorption fields. A flow divider (24) extends across an outlet line (22) in the throat area where the distribution lines (16*a* and 16*b*) join. A cylindrical control sleeve or flow director (26) is rotatably mounted inside the effluent line (14) and is used to direct the effluent into the respective distribution line (16*a* and 16*b*)**.

U.S. Pat. No. 4,838,731 discloses a pivotable tray (26), which is installed within a distribution box (12). The effluent from the septic tank flows into this pivotable tray (26) where it collects until its weight causes the tray (26) to pivot and discharge effluent among various discharge outlet pipes (52).

U.S. Pat. No. 5,322,387 discloses a complicated distribution system for equalizing the flow of fluid through a sewage disposal system.

U.S. Pat. Nos. 5,107,892, 5,154,353 and 5,680,989 disclose a cap that is placed on the end of piping present in a distribution box. Each of these caps contains a weir, which is designed to equalize the flow of effluent out of the discharge pipes of the distribution box.

U.S. Pat. No. 3,956,137 discloses a sewage septic system which contains a plurality of discharge lines (23, 24). The flow of effluent in each of these discharge lines may be controlled by a separate gate valve (26, 27), each of which permits full flow, partial flow or no flow through its respective discharge line.

The present invention is designed to distribute effluent equally among several discharge pipes and represents a significant improvement over the previous products. It includes a distribution system designed to equalize the flow of effluent from a septic tank system into discharge pipes, even when the quantity of the effluent entering the distribution box is very low.

Under normal conditions, the flow of effluent from a septic tank into a distribution box typically occurs in small quantities. This is due to the effect of small quantities of wastewater entering a large septic tank. The typical quantity of wastewater entering a septic tank is no more than about 5 gallons, and frequently less than 1–2 gallons. Each such discharge into the septic tank results in only small, slow pulsing discharges of effluent out of the septic tank to the distribution box. With this slow flow of effluent into the distribution box, even minor differences in the relative position of the effluent discharge piping in the distribution box results in a disproportionate flow of the effluent into one or more of the discharge pipes out of the distribution box. The use of weirs does not completely solve this problem with low flows of effluent. With such low flows, once the surface tension is broken on one outlet pipe opening, the effluent will continue to flow only out that outlet pipe until the surface tension on other outlet pipes is also broken.

Accordingly, it is an object of the invention to provide an improved product for distributing effluent from a septic system in generally equal quantities into multiple discharge pipes.

It is a still further object of the invention to provide a system which equalizes the flow of effluent out of a distribution box.

It is a still further object of the invention to disclose a system for splitting the flow of effluent entering a discharge box into a number of different sumps, each with a separate discharge pipe, even under low flow conditions.

It is a still further object of this invention to utilize a ramp system contained within a low capacity liquid flow splitting system to spread the flow of the effluent across the low flow splitting system.

It is a still further object of the invention to utilize a series of slots in the ramp system to equalize the flow of effluent into separate discharge pipes.

It is a still further object of the invention to utilize a plurality of capillary grooves in the slots in the ramp system to equalize the flow of effluent into separate discharge pipes.

It is a still further object of the invention to utilize a high capacity liquid flow splitting system in conjunction with the low flow system to equalize the flow of effluent into separate discharge pipes.

It is a still further object of the invention to provide an adjustment system for adjusting the relative position of the liquid flow splitting system within an effluent discharge system.

These and other objects of the invention will be apparent from the effluent distribution system disclosed by the present invention.

SUMMARY OF INVENTION

The present invention discloses a liquid distribution system, particularly an effluent distribution system enclosed in a distribution box. Effluent from a septic tank flows into a distribution box through an inlet pipe for distribution by outlet pipes into an absorption field. The liquid distribution system includes a low capacity liquid flow splitting system in communication with the inlet pipe, and preferably a high capacity liquid flow splitting system, containing a plurality of separate liquid outlet flow splitting elements. A series of separate liquid outlet flow channels are formed by these systems which encourage the effluent into separate sumps for discharge into separate outlet pipes for final distribution in an absorption field.

In a preferred embodiment, the low capacity liquid flow splitting system includes a ramp system and a series of slots and capillary grooves in the ramp system which enhance the capability of the system to divide the effluent into a plurality of substantially equal streams of effluent for distribution into separate sumps for discharge into separate outlet pipes for distribution in an absorption field.

In a further preferred embodiment a liquid inlet dam is secured across the ramp system, which restricts the flow of effluent into the ramp system.

In a further preferred embodiment, the ramp system is inclined at an angle of at least about 5° above level.

In a further preferred embodiment, the high capacity liquid flow splitting system includes slots for outlet flow stop elements in the outlet flow channels to reduce the number of available liquid outlet flow channels which can be used.

In a further preferred embodiment, the liquid distribution system includes a level system to monitor the relative position of the liquid distribution system in the ground and an adjusting system to adjust the relative position of the liquid distribution system in the ground.

In a further preferred embodiment, an inspection port is provided in the liquid distribution system so that the relative position of the liquid distribution system can be monitored from above ground.

DETAILED DESCRIPTION OF THE PREFERRED EMBODIMENT

Figure 1:
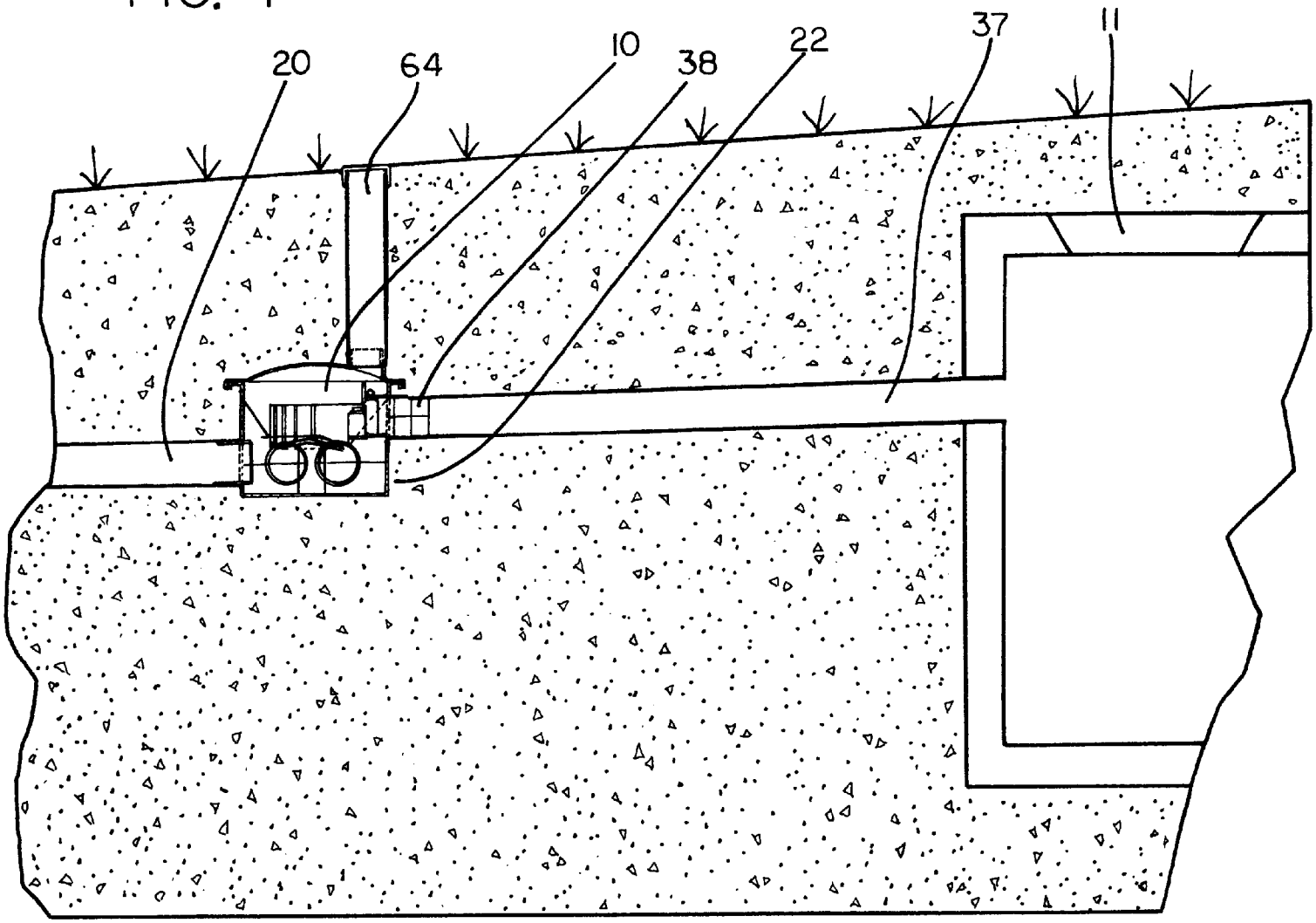
FIG. 1 is a side view of the liquid distribution system in a distribution box connected to a septic tank system in the ground.

The liquid distribution system (10) of the present invention divides the flow of effluent discharged from a septic tank (11), as shown in FIG. 1. The amount of effluent entering a septic tank (11) during a single usage may be as little as 1 to 2 gallons. Because of the large surface area of the septic tank (11), this inflow only increase the height of the effluent in the septic tank (11) by ⅛ of an inch or less. As a result, the quantity of effluent discharged from the septic tank (11) into a distribution box (22) may be quite small. Further, the rate of the flow of this discharged effluent may also be quite slow. The present invention is a liquid distribution system (10) designed to receive small or large quantities of effluent and divide that effluent into a series of relatively equal quantities for distribution to separate sumps (25) and then to separate outlet pipes (20) in an absorption field as shown in FIGS. 2 and 3.

Figure 2:
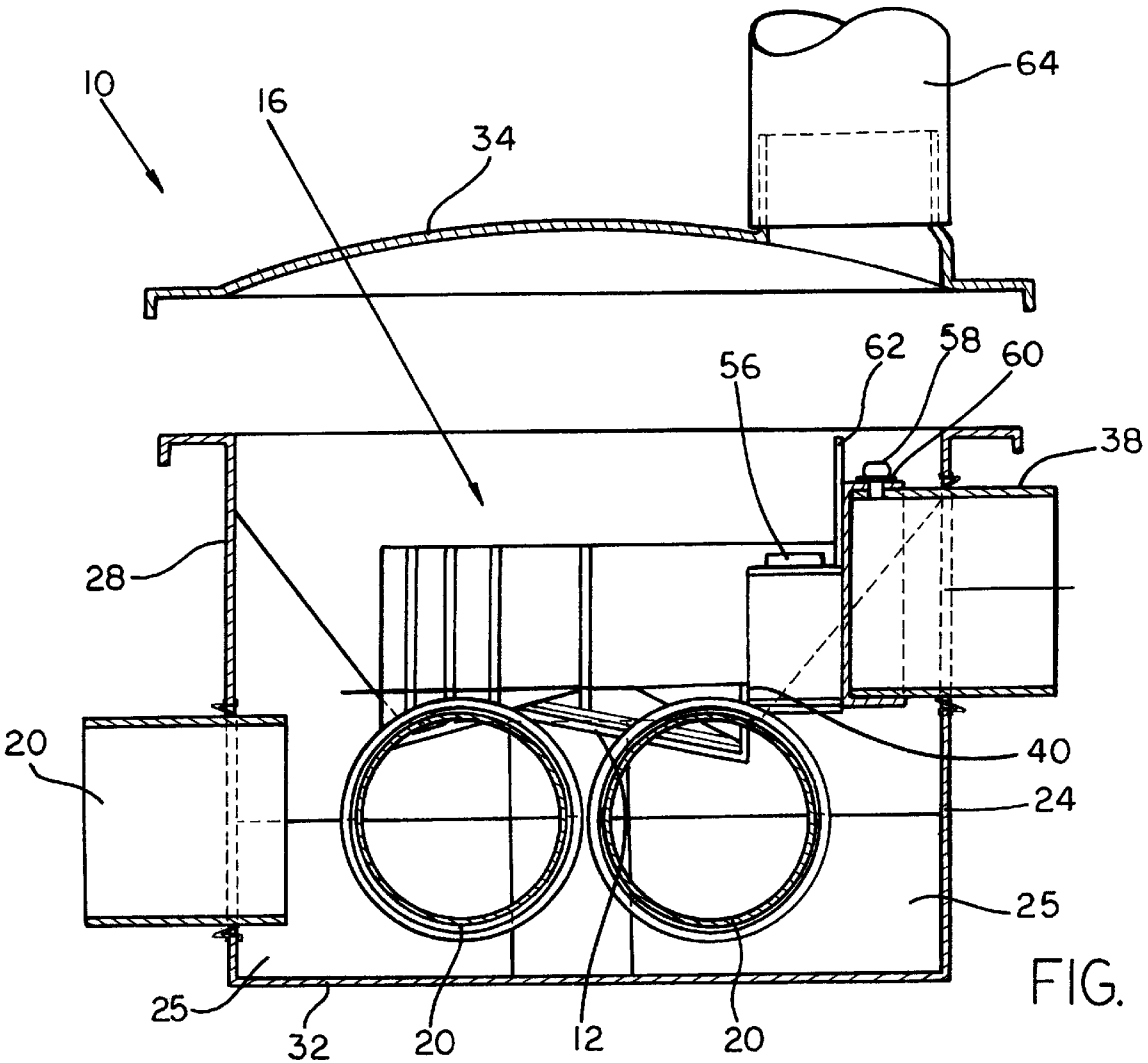
FIG. 2 is a side view of the liquid distribution system in the distribution box.
Figure 3:
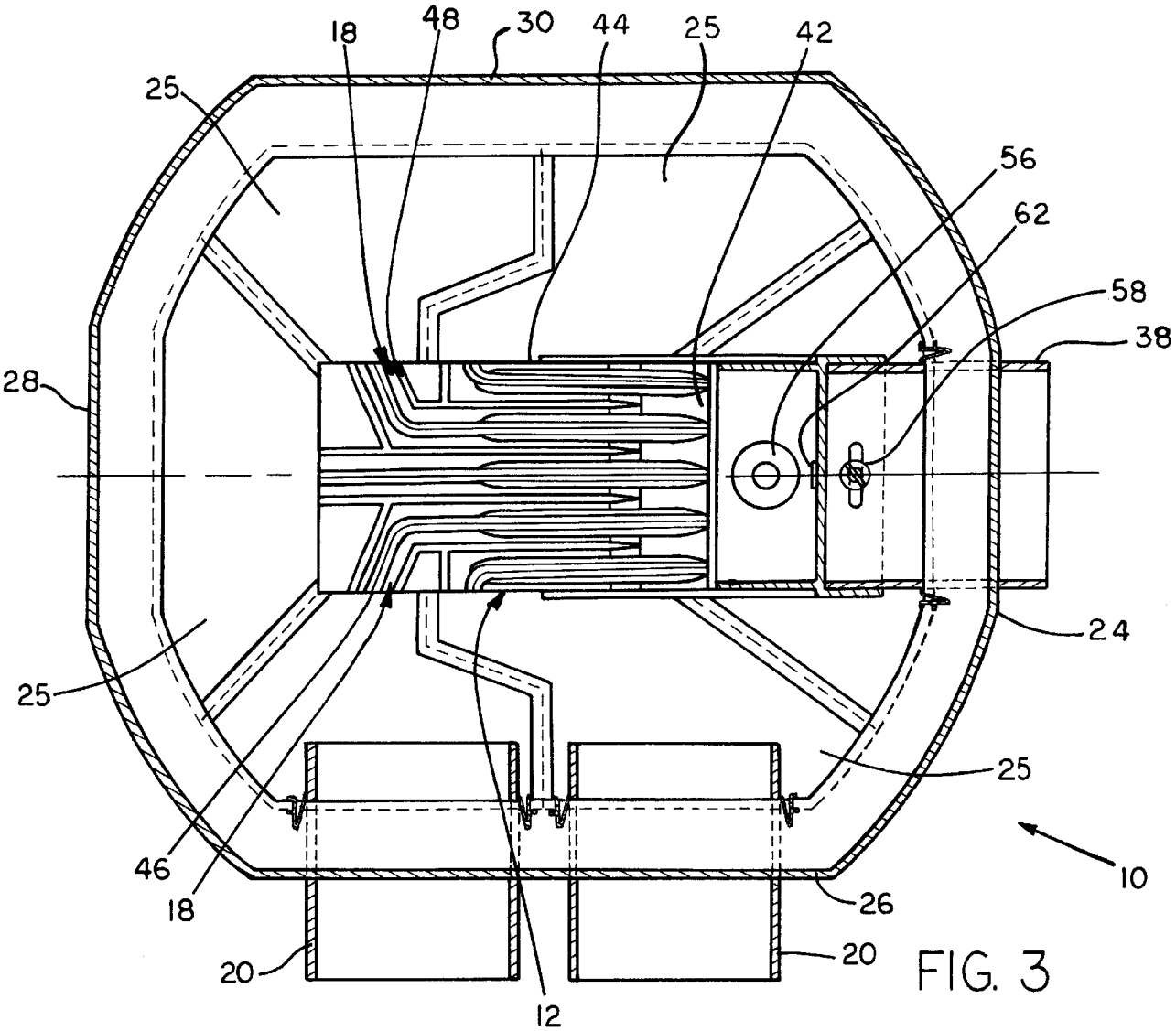
FIG. 3 is a top view of the liquid distribution system in the distribution box.

The liquid distribution system (10) of the present invention, as shown in FIGS. 1, 2 and 3, divides the flow of effluent into a series of generally equal quantities and includes a ramp system (12), a low capacity liquid flow splitting system (14), and preferably, a high capacity liquid flow splitting system (16). The low capacity liquid flow splitting system (14), as shown particularly in FIGS. 4 and 5, includes a plurality of liquid outlet flow channels (18), which channels are in communication with sumps (25) and then to outlet pipes (20) to discharge effluent from the liquid distribution system (10) into the absorption fields.

The liquid distribution system (10) is designed for utilization with a waste water distribution system, for example, a septic tank system. The liquid distribution system (10) is preferably enclosed within a distribution box (22) having four sides (24, 26, 28, 30), a base (32) and a removable top (34), as shown in FIGS. 2 and 3. This distribution box (22) is located downstream from a septic tank (11) and is buried underground.

Figure 4:
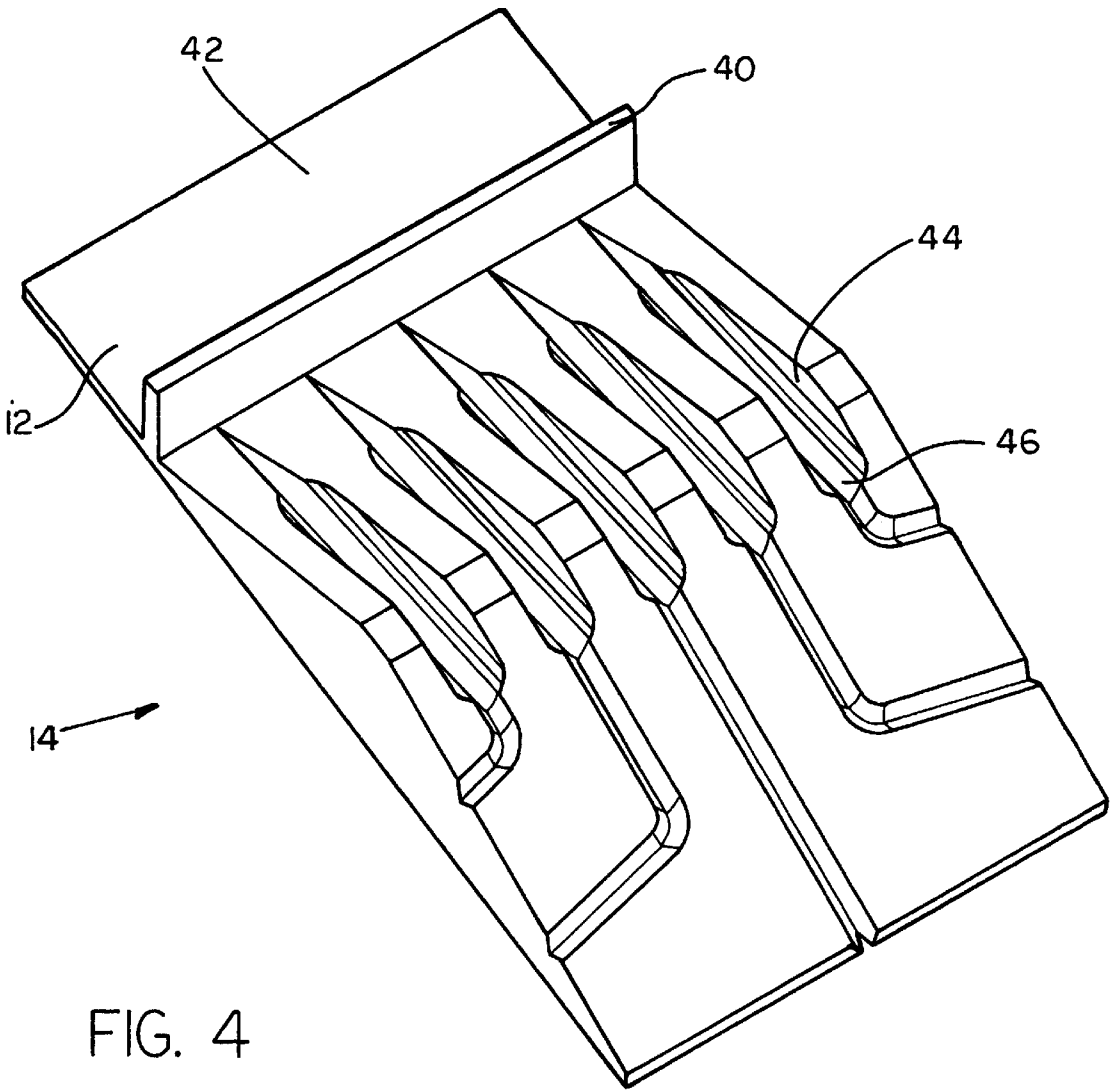
FIG. 4 is a top perspective view of the low capacity liquid flow splitting system of the liquid distribution system.
Figure 5:
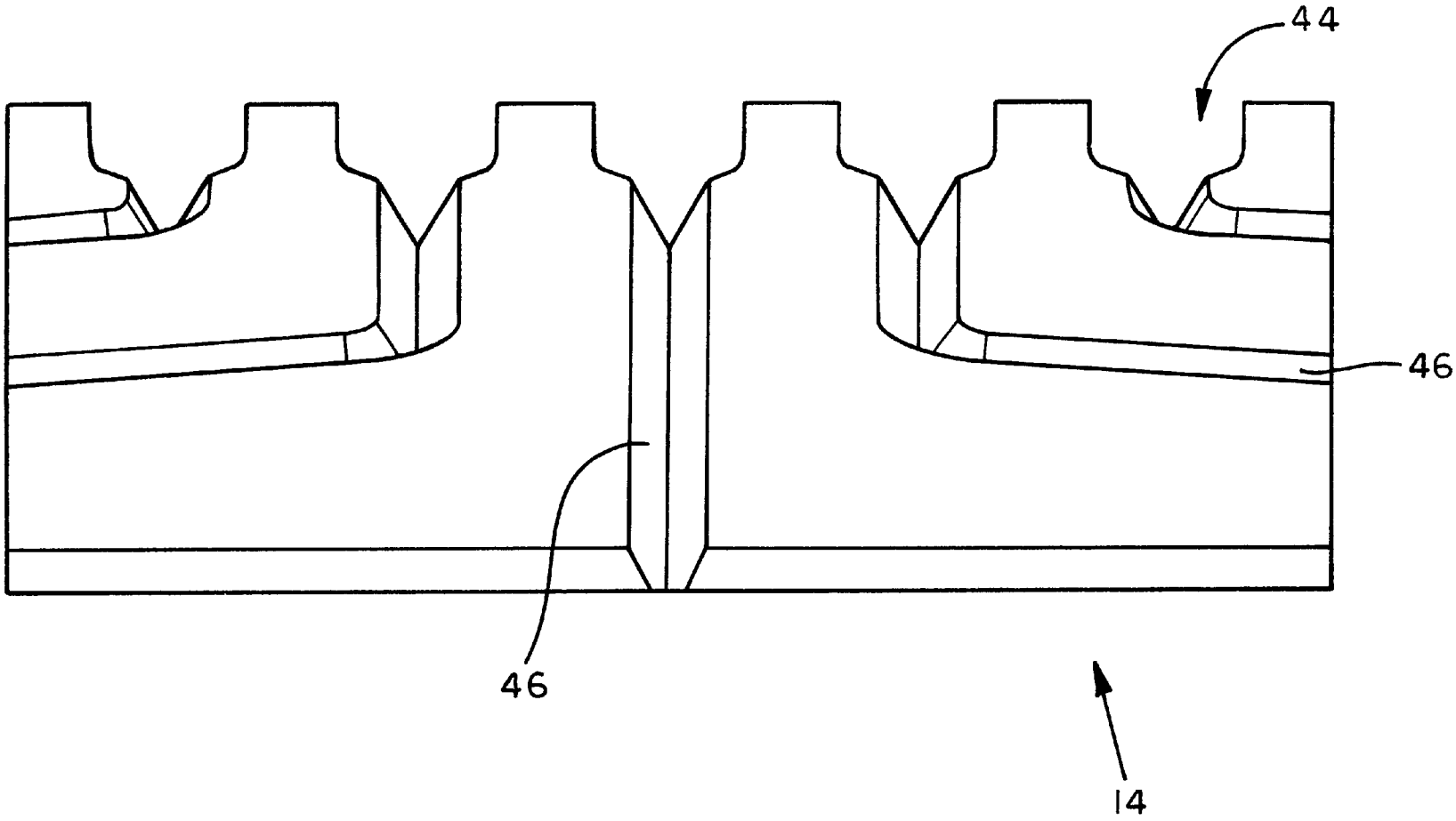
FIG. 5 is a rear view of the low capacity liquid flow splitting system of the liquid distribution system.

Effluent enters the distribution box (22) through an inlet pipe (38), as shown in FIG. 1. The ramp system (12) is in communication with this inlet pipe (38). This ramp system (12), as shown in FIGS. 4 and 5, has a flat bottom and is preferably rectangular or square in cross-section, although other shapes are certainly contemplated by the invention. As the effluent enters the ramp system (12), it first preferentially encounters a liquid inlet dam (40). Because the inlet pipe (38) is circular in cross section, there is a variance in the kinetic pressure in the effluent across the inlet pipe (38). The ramp system (12) and the liquid inlet dam (40) help discharge this kinetic energy. This liquid inlet dam (40) is preferably no more than about 1.0 inch in height, but may be shorter or taller, as long as it does not create significant backflow of the effluent. The inlet dam (40) equalizes the flow of effluent across the width of the distribution box (22). Although the usage of this inlet dam (40) is preferred, the invention also includes systems which do not include an inlet dam (40). The purpose of the liquid inlet dam (40) is to control the flow of the effluent into the liquid distribution system (10) and partially disperse the kinetic energy present in the flowing effluent. By use of this liquid inlet dam (40), the flow of effluent is extended across the width of the ramp system (12).

In one preferred embodiment, as shown in FIG. 2, the surface of the ramp system (12) rises. The angle of the rise of the ramp system (12) is preferably no more than about 30°, and more preferably, from about 5° to about 15°. One of the purposes of the upward angle of the ramp system (12) is to insure that the flow of the effluent rises within the distribution box (22), even if the level of the ramp system (12) changes as a result of improper installation of the distribution box (22) or from changes in the relative position of the distribution box (22) as a result of settling.

The low capacity liquid flow splitting system (14) is incorporated into the ramp system (12). The low capacity liquid flow splitting system (14) includes a series of slots (44) cut into the surface (42) of the ramp system (12) as shown particularly in FIGS. 4 and 5. These slots (44) begin at a point where the effluent begins to rise up the ramp system (12) at a height no more than about 1/32 of an inch to about 3/4 of an inch above the lowest level of the ramp system (12). Two or more slots (44) are present in the ramp system (12) and preferably four or more such slots (44) are utilized. These slots (44) have a generally smooth surface and are generally no more than about 3/4 of an inch in depth at their maximum depth. They are preferably from about 2 to about 12 inches in length and are generally consistent in relative depth over their entire length.

The slots (44) also rise with the ramp system (12) and may continue that rise even after the ramp system begins a downward fall, as shown particularly in FIG. 2. The angle of the rise of the slots (44) is preferably less than the angle of the rise of the ramp system (12) itself, preferably from about 2° to about 30° and more preferably from about 2° to about 15°. These slots (44) assist in the equalization of the distribution of the effluent across the ramp system (12). It is important that these slots (44) be angled upward at a sufficient angle to permit distribution of the effluent regardless of the relative position of the distribution box (22). By angling these slots (44) upward at least about 10°, the low capacity liquid flow splitting system (14) can accommodate significant variations in the placement of the distribution box (22), either from inaccurate installation or settling of the distribution box (22) over time.

In a preferred embodiment, one or more capillary grooves (46) are cut into the bottom of the slots (44) as shown in FIGS. 3, 4 and 5. These capillary grooves (46) are preferably no less than about 1/8 of an inch in depth and about 1/8 of an inch in width, and preferably extend at least the length of the slots (44). In a preferred embodiment the grooves (46) extend beyond the length of the slots (44) all the way to each respective outlet pipe (20), as shown in FIGS. 3 and 4. These capillary grooves (46) enhance the flow of effluent through the low capacity liquid flow splitting system (14). Continuing the capillary grooves (46) along the liquid outlet flow channels (18) creates a better, more equal, flow pattern for the effluent.

As a result of the ramp system (12) and the low capacity liquid flow splitting system (14), which includes slots (44) and preferably capillary grooves (46), low quantities of effluent flowing even at reduced rates over the ramp system (12) is split into a plurality of separate, generally equal, streams of effluent, each running through a separate slot (44) into a separate liquid outlet flow channel (18) for discharge into a separate outlet pipe (20).

The low capacity liquid flow splitting system (14) is effective in splitting the flow of the effluent when the quantity of the effluent discharged into the liquid distribution system (10) is low. However, when the quantity of effluent passing through the liquid distribution system (10) increases, a high capacity liquid flow splitting system (16) preferably is included in the liquid distribution system (10).

Figure 6:
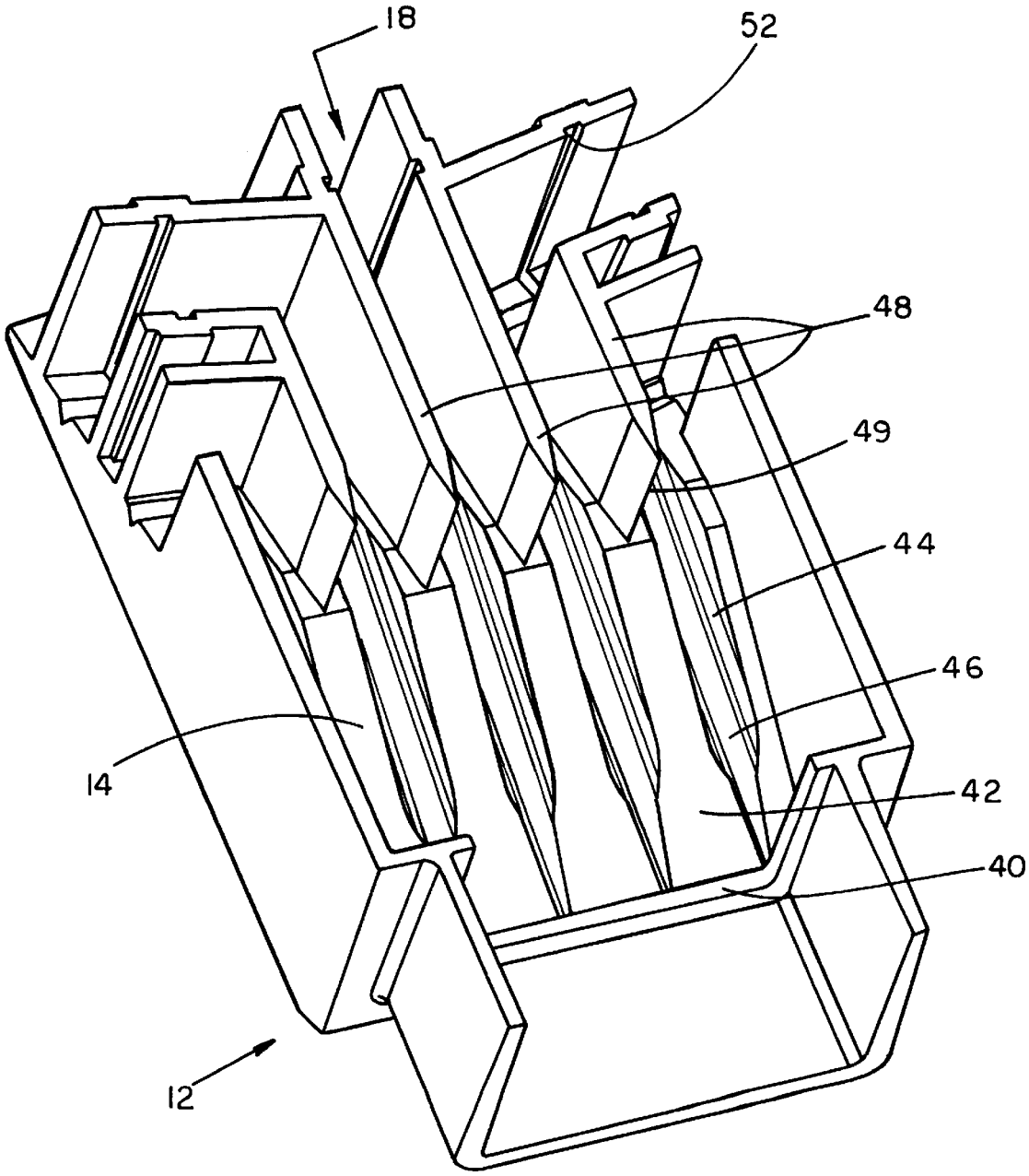
FIG. 6 is a top perspective, cutaway view of the low capacity liquid flow splitting system used in combination with the high capacity liquid flow splitting system of the liquid distribution system.
Figure 7:
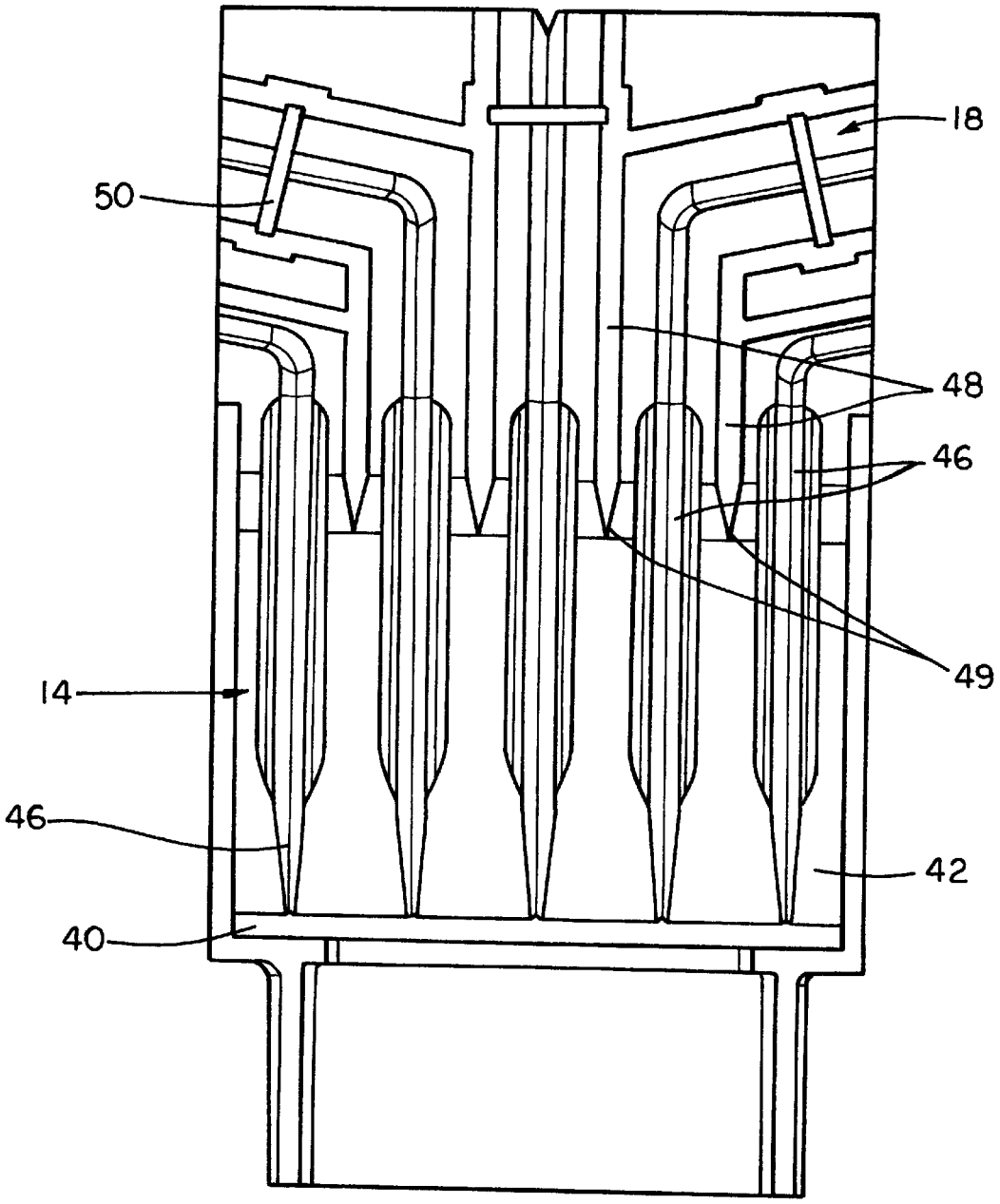
FIG. 7 is a top, cutaway view of the low capacity liquid flow splitting system used in combination with the high capacity liquid flow splitting system of the liquid distribution system.
Figure 8:
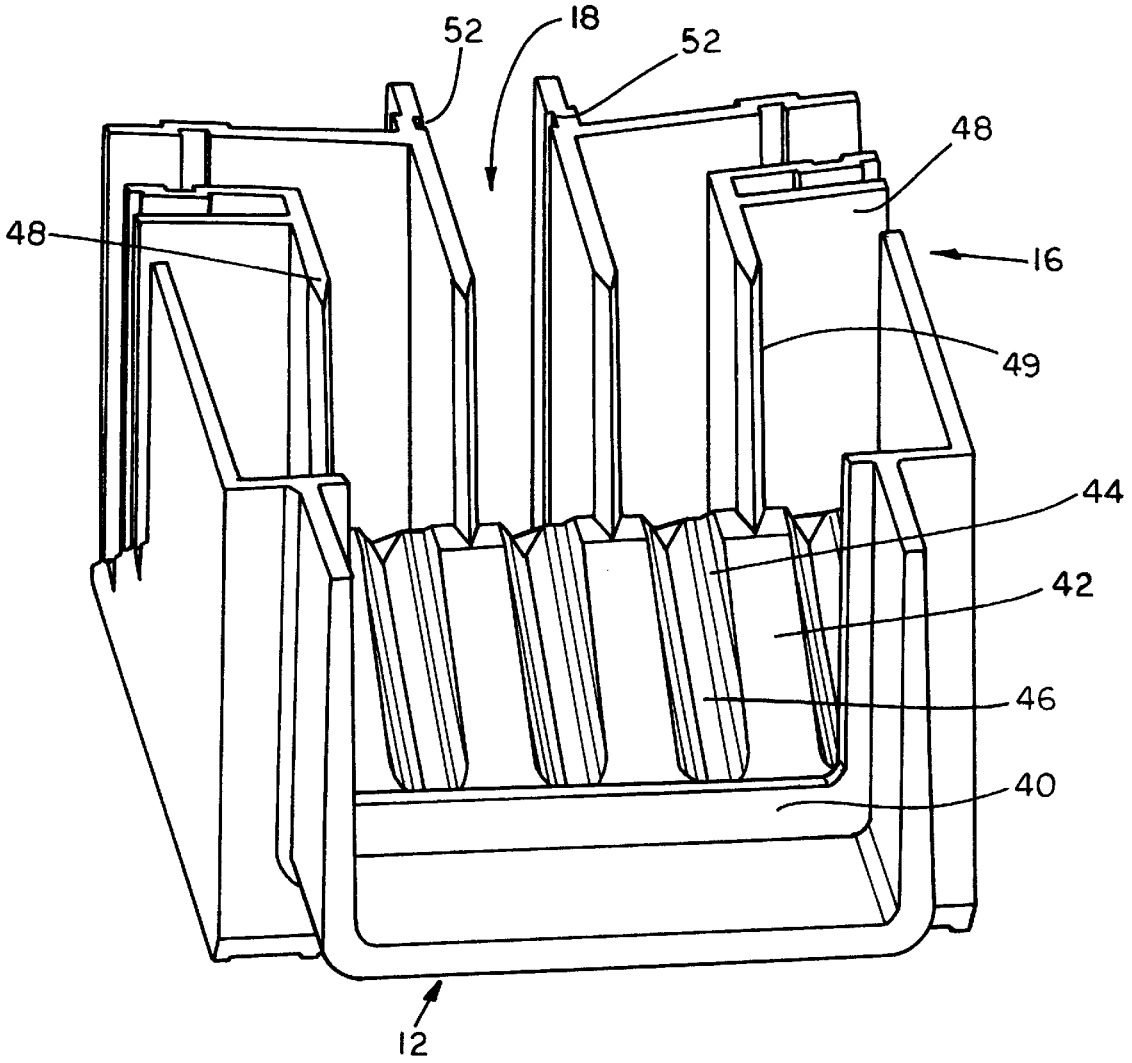
FIG. 8 is a front cutaway view of the low capacity liquid flow splitting system used in combination with the high capacity liquid flow splitting system.
Figure 9:
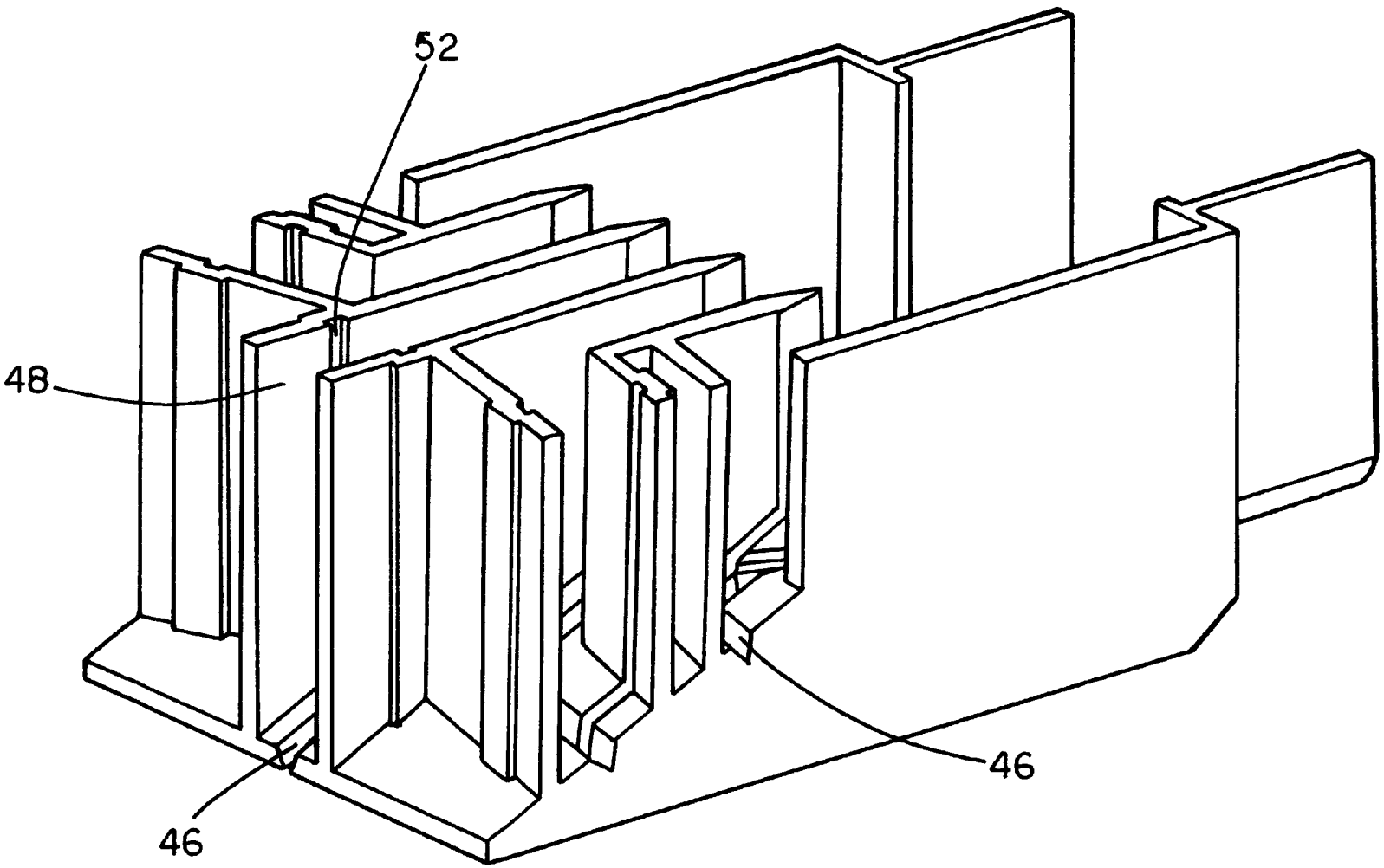
FIG. 9 is a side cutaway view of the low capacity liquid flow splitting system used in combination with the high capacity liquid flow splitting system.

In one preferred embodiment, the high capacity liquid flow splitting system (16) is utilized with the ramp system (12) and the liquid inlet dam (40), as shown in FIGS. 6, 7, 8 and 9. The high capacity liquid flow splitting system (16) includes a series of liquid flow splitting elements (48) which extend from the surface of the ramp system (12) to or near the top of the distribution box (22) to assist in formation of the individual liquid outlet flow channels (18). These liquid flow splitting elements (48) are preferably arranged in a generally parallel pattern as shown in FIGS. 7 and 8 perpendicular to the horizontal flow of effluent through the distribution box (22). These liquid outlet flow channels (18) are preferably walls or dams that extend through the distribution box (22) from or near the beginning of the ramp system (12) to the sumps (25) and then to the outlet openings in the separate outlet pipes (20). Preferably, the front edge (49) of each liquid flow splitting element (48) has a sharp edge as shown in FIGS. 6, 7 and 8 for a better division of the effluent. Any number of such liquid flow splitting elements (48) may be included in the liquid distribution system (10). As shown in FIGS. 6 through 9, four liquid flow splitting elements (48) are utilized which form five separate liquid outlet flow channels (18) generally parallel in pattern and perpendicular to the horizontal flow of the effluent. These liquid flow splitting elements (48) assist in the division of the effluent to be discharged from the liquid distribution system (10).

When the low capacity liquid flow splitting system (14) is utilized in combination with the high capacity liquid flow splitting system (16), the slots (44) of the low capacity liquid flow splitting system (14) used in combination with the capillary grooves (46) separate the flow of effluent into a series of separate streams of effluent, one of which flows through each individual slot (44) into a separate liquid outlet flow channel (18) for ultimate discharge into the outlet pipes (20). As shown in FIGS. 3, 7, 8 and 9, the capillary grooves (46) flow from the beginning of the slots (44) through the separate liquid outlet flow channels (18) until they flow into the separate outlet pipes (20).

To reduce the number of liquid outlet flow channels (18) which discharge effluent from the liquid distribution system (10), liquid outlet stops (50) may be incorporated into liquid outlet stop slots (52) in the liquid flow splitting elements (48), as shown in FIGS. 6 and 7. Each liquid outlet stop (50) prevents the flow of effluent out of a single liquid outlet flow channel (18). When a liquid outlet stop (50) is installed within the liquid outlet stop slots (52), the effluent backs up in that particular liquid outlet flow channel (18) and is discharged through adjacent liquid outlet channels (18) which do not contain liquid outlet stops (50). Any number of outlet pipes (20) may be used with this system. As shown in the drawings five separate outlet pipes are shown. More or less may be used with the system (10).

Even with this improved liquid distribution system (10), in order to assure that equalization of the flow of the effluent occurs among the respective liquid outlet flow channels (18) of the low capacity liquid flow splitting system (14), it is important that the ramp system (12) be maintained in a level position. Effluent entering the distribution box (22) has a tendency to flow out of the lowest liquid outlet flow channel (18), even with the use of both the low capacity liquid flow splitting system (14) and the high capacity liquid flow splitting system (16) and even if the ramp system (12) is only slightly out of level. Thus, in a preferred embodiment, an adjustment system (54) is incorporated into the liquid distribution system (10) to level the ramp system (12), as shown on FIGS. 2 and 3. In a preferred embodiment, this adjustment system includes a bubble level (56), which shows the relative position of the ramp system (12). The adjustment system (54) also preferably includes a thumb screw (58) with washer (60) and an adjusting lever (62). With a wrench (not shown), preferably a thumb screw wrench on a rod (not shown), the thumb screw (58) is loosened and the lever (62) is moved by the wrench on the rod. After the bubble level (56) is centered, the thumb screw (59) is tightened to secure the ramp system (12) in place.

To monitor the flow of the effluent through the liquid distribution system (10) and to assure that the ramp system (12) is maintained level, preferably an inspection port (64) is incorporated into the removable top (34) of the distribution box (22), as shown in FIGS. 1 and 2. This inspection port (64) permits viewing of the adjustment system (54) and provides an opening for access to the liquid distribution system (10) by a person on the surface. This person can view the bubble level (56) and make adjustments to the relative position of the liquid distribution system (10) by manipulating the adjusting lever (62)of the adjustment system (54).

In operation, effluent from the septic tank (11) passes down its discharge piping (37) into the inlet pipe (38) for passage through the distribution box (22). The effluent enters the ramp system (12) from the inlet pipe (38) where it is first slowed in progress by the liquid inlet dam (40). Once sufficient effluent has entered the ramp system (12) to spill over the liquid inlet dam (40), the effluent flows up the inclined ramp system (12). The effluent then encounters the series of slots (44) in the low capacity liquid flow splitting system (14) and, in a preferred embodiment, the series of capillary grooves (46), contained within the slots (44) which cause the effluent to split its flow among the slots (44).

The liquid distribution system (10) preferably also includes the high capacity liquid flow splitting system (16), which includes liquid flow splitting elements (48), preferably arranged in a parallel pattern perpendicular to the horizontal flow of effluent which assist in the formation of the series of liquid outlet flow channels (18). The effluent passing through each slot (44) is channeled into these separate liquid outlet flow channels (18). The effluent is thus divided into generally equal, separate streams of effluent which pass through the liquid outlet flow channels (18) and fall down into the sumps (25) and then to outlet pipes (20) for distribution among the various lines of the absorption fields.

In a further preferred embodiment, an adjusting system (54) is also incorporated into the liquid distribution system (10) which includes a bubble level (56) to indicate the relative position of the liquid distribution system (10) and an adjusting lever (62) to adjust the relative position of the liquid distribution system (10).

By this liquid distribution system (10), the amount of effluent can be equalized among the various outlet pipes (20) so that disproportionate loading of any individual outlet pipe (20) is discouraged.

It will be apparent from the foregoing that while particular forms of the invention have been illustrated and described, various modifications can be made without departing from the spirit and scope of the invention.

We claim:

1. A liquid distribution system comprising a liquid inlet system, an inclined ramp system in communication with the liquid inlet system, a low capacity liquid flow splitting system secured to the ramp system, wherein the low capacity liquid flow splitting system comprises a plurality of slots extending up the inclined ramp system, and a liquid outlet system.

2. The liquid distribution system of claim 1 further comprising extended capillary grooves cut into the slots.

3. The liquid distribution system of claim 1 further comprising a liquid inlet dam secured to the ramp system.

4. The liquid distribution system of claim 1 wherein a portion of the ramp system is inclined at an angle of at least about 5.0°.

5. The liquid distribution system of claim 1 further comprising an adjustment system for monitoring the relative position of the ramp system in the ground.

6. The liquid distribution system of claim 5 further comprising a system for adjusting the relative position of the ramp system in the ground.

7. The liquid distribution system of claim 1 further comprising a high capacity liquid flow splitting system in communication with the low capacity liquid flow splitting system.

8. The liquid distribution system of claim 7 wherein the high capacity liquid flow splitting system comprises a plurality of liquid flow splitting elements.

9. The liquid distribution system of claim 8 wherein the high capacity liquid flow splitting system further comprises a removable stop to stop the flow of effluent.

10. The liquid distribution system of claim 1 further comprising a viewing system to view the relative position of the liquid distribution system in the ground from above ground.

11. The liquid distribution system of claim 10 wherein the viewing system comprises an inspection port.

12. A liquid distribution system comprising a liquid inlet system, an inclined ramp system in communication with the liquid inlet system, a liquid inlet dam secured to the ramp system, a low capacity flow splitting system comprising a plurality of slots in the ramp system, and a liquid outlet system.

13. The liquid distribution system of claim 12 further comprising a capillary groove cut in the slots.

14. The liquid distribution system of claim 12 wherein a portion of the ramp system is inclined at an angle of at least about 5.0°.

15. The liquid distribution system of claim 12 further comprising an adjustment system for adjusting the relative position of the ramp system.

16. The liquid distribution system of claim 15 further comprising a system for monitoring the relative position of the liquid outflow system in the ground.

17. The liquid distribution system of claim 12 further comprising a viewing system to view the relative position of the liquid distribution system in the ground from above ground.

18. The liquid distribution system of claim 17 wherein the viewing system comprises an inspection port.

19. The liquid distribution system of claim 12 further comprising a high capacity liquid flow splitting element.

20. The liquid distribution system of claim 12, wherein the high capacity liquid flow splitting system comprises a plurality of liquid flow splitting elements which form a plurality of liquid outlet flow channels.

21. The liquid distribution system of claim 20 wherein the high capacity liquid flow splitting element further comprises a removable stop present in the liquid outlet flow channel.

22. An effluent distribution system comprising a septic tank, a piping system in communication with the septic tank, a liquid distribution box in communication with the piping system, a liquid inlet system in communication with the liquid distribution system, an inclined ramp system in communication with the liquid inlet system, a low capacity flow splitting system, wherein the low capacity liquid flow splitting system comprises a plurality of slots extending up the inclined ramp system, and, a liquid outlet system.

23. The liquid distribution system of claim 22 further comprising extended capillary grooves cut in the slots.

24. The liquid distribution system of claim 22 further comprising a liquid inlet dam secured to the ramp system.

25. The liquid distribution system of claim 22 further comprising an adjustment system for adjusting the relative position of the ramp system in the ground.

26. The liquid distribution system of claim 25 further comprising a system for monitoring the relative position of the liquid outflow system in the ground.

27. The liquid distribution system of claim 22 further comprising a viewing system to view the relative position of the liquid distribution system in the ground from above ground.

28. The liquid distribution system of claim 27 wherein the viewing system comprises an inspection port.

29. The liquid distribution system of claim 22 further comprising a high capacity liquid flow splitting system.

30. The liquid distribution system of claim 29 wherein the high capacity liquid flow splitting system comprises a plurality of liquid flow splitting elements which form a plurality of liquid outlet flow channels.

31. The liquid distribution system of claim 29, wherein the high capacity liquid flow splitting system further comprises a removable stop present in the liquid outlet flow channel.

* * * * *